US012550994B2

(12) United States Patent
Wojczak

(10) Patent No.: US 12,550,994 B2
(45) Date of Patent: Feb. 17, 2026

(54) GLASS OR GLASS-LIKE STYLING COMPONENT FOR A HAIR DRYER

(71) Applicant: CONAIR LLC, Stamford, CT (US)

(72) Inventor: Sophia Wojczak, Harrison, NY (US)

(73) Assignee: CONAIR LLC, Stamford, CT (US)

( * ) Notice: Subject to any disclaimer, the term of this patent is extended or adjusted under 35 U.S.C. 154(b) by 381 days.

(21) Appl. No.: 17/959,410

(22) Filed: Oct. 4, 2022

(65) Prior Publication Data

US 2023/0131861 A1 Apr. 27, 2023

Related U.S. Application Data

(60) Provisional application No. 63/271,739, filed on Oct. 26, 2021.

(51) Int. Cl.
*A45D 20/12* (2006.01)

(52) U.S. Cl.
CPC ..... *A45D 20/12* (2013.01)

(58) Field of Classification Search
USPC ..... 132/271, 272
See application file for complete search history.

(56) References Cited

U.S. PATENT DOCUMENTS 4,538,362 A * 9/1985 Andis ..... A45D 20/122 34/97
5,729,907 A * 3/1998 Santhouse ..... A45D 2/002 34/98
6,009,883 A * 1/2000 Morrow ..... A45D 2/001 132/211
7,047,660 B2 * 5/2006 Leventhal ..... A45D 20/122 34/97
7,178,261 B2 * 2/2007 McCambridge ..... A45D 20/124 219/222
8,209,877 B2 * 7/2012 Smal ..... A45D 20/122 34/96
9,622,561 B2 * 4/2017 Cohen ..... A45D 20/12
D833,069 S * 11/2018 Broides ..... D28/18
2001/0051042 A1 12/2001 Ohmura
2005/0109755 A1 5/2005 Rachal
2005/0229423 A1 * 10/2005 Keong ..... A45D 20/12 34/524
2011/0277335 A1 11/2011 Prehodka
2013/0025106 A1 1/2013 Hernandez-Laines
2016/0120286 A1 * 5/2016 Han ..... A45D 20/00 132/271

(Continued)

FOREIGN PATENT DOCUMENTS

GB 2508589 A * 6/2014 ..... A45D 20/122

OTHER PUBLICATIONS

International Search Report dated Feb. 9, 2023 from corresponding International Application No. PCTUS22/45605.

*Primary Examiner* — Tatiana L Nobrega
(74) *Attorney, Agent, or Firm* — Grogan, Tuccillo & Vanderleeden, LLP

(57) ABSTRACT

A styling attachment for a hair dryer includes a hub configured for releasable attachment to a nozzle of a hair dryer, a nozzle defining an opening for passage of heated air, and a bar mounted within the opening and at least partially obstructing a flow of air through the opening. The bar is configured to retain heat from the flow of air past the bar, and to transfer the heat to hair of a user when contacted with the hair.

6 Claims, 6 Drawing Sheets

(56) References Cited

U.S. PATENT DOCUMENTS

| | | | | |
|---|---|---|---|---|
| 2018/0055188 | A1* | 3/2018 | Potts | A45D 20/48 |
| 2018/0078016 | A1* | 3/2018 | Bridgett | A45D 20/12 |
| 2019/0045900 | A1* | 2/2019 | Joe | A46D 1/00 |
| 2022/0202156 | A1* | 6/2022 | Richards | A45D 20/12 |

* cited by examiner

GLASS OR GLASS-LIKE STYLING COMPONENT FOR A HAIR DRYER

CROSS-REFERENCE TO RELATED APPLICATIONS

This application claims the benefit of U.S. Provisional Application Ser. No. 63/271,739 filed on Oct. 26, 2021, which is hereby incorporated by reference in its entirety.

FIELD OF THE INVENTION

The present invention relates generally to hair styling devices and, more particularly, to a hair dryer and accessory for a hair dryer having a heat-retaining styling component.

BACKGROUND OF THE INVENTION

A hair dryer, also referred to as a blow dryer, is generally designed to emit a concentrated flow of heated air from a nozzle to quickly dry hair. Known hair dryers typically include a housing having a handle portion and a nozzle portion. A heating element mounted within the housing is configured to generate heat when supplied with electricity, while a fan driven by a motor within the housing draws outside air into the housing through a filter in the rear of the housing. As the air is forced across the heating element, it is heated, before being expelled out of the front of the nozzle portion.

There also exist a variety of accessories configured for attachment to the nozzle end of a hair dryer for changing the air flow pattern and/or for interfacing with the hair of a user for imparting various styling effects. Such attachments include, for example, concentrators, diffusers and picks/combs.

While existing hair dryers and nozzle attachments therefor are generally suitable for what may be regarded as ordinary performance, there is a need for improvements in terms of the functionality of such devices.

SUMMARY OF THE INVENTION

It is an object of the present invention to provide an attachment for a hair dryer having a component configured to produce one or more styling effects on a user's hair.

It is another object of the present invention to provide a hair dryer having a component configured to produce one or more styling effects on a user's hair.

It is another object of the present invention to provide a hair dryer or attachment for a hair dryer having a component configured to retain heat for subsequent transfer to the hair of a user.

These and other objects are achieved by the present invention.

According to an embodiment of the present invention, a styling attachment for a hair dryer includes a hub configured for releasable attachment to a nozzle of a hair dryer, a nozzle defining an opening for passage of heated air, and a bar mounted within the opening and at least partially obstructing a flow of air through the opening. The bar is configured to retain heat from the flow of air past the bar, and to transfer the heat to hair of a user when contacted with the hair.

According to another embodiment of the invention, a hair dryer includes a housing having a handle portion and a nozzle portion, a motor within the housing, a fan drivingly connected to the motor within the housing, a heating element within the housing, and a bar mounted within the nozzle portion adjacent to an outlet end of the nozzle portion, the bar at least partially obstructing a flow of air at the outlet end. The bar is configured to retain heat from the flow of air past the bar, and to transfer the heat to hair of a user when contacted with the hair.

According to yet another embodiment of the invention, a method for styling hair includes the steps of securing a styling attachment to a nozzle end of a hair dryer, the styling attachment having a bar extending across a flow passage of the styling attachment, activating a hair dryer to provide a flow of heated air through the flow passage of the styling attachment and across the bar to heat the bar, and contacting hair of a user with the bar to style the hair.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENT

Figure 1:
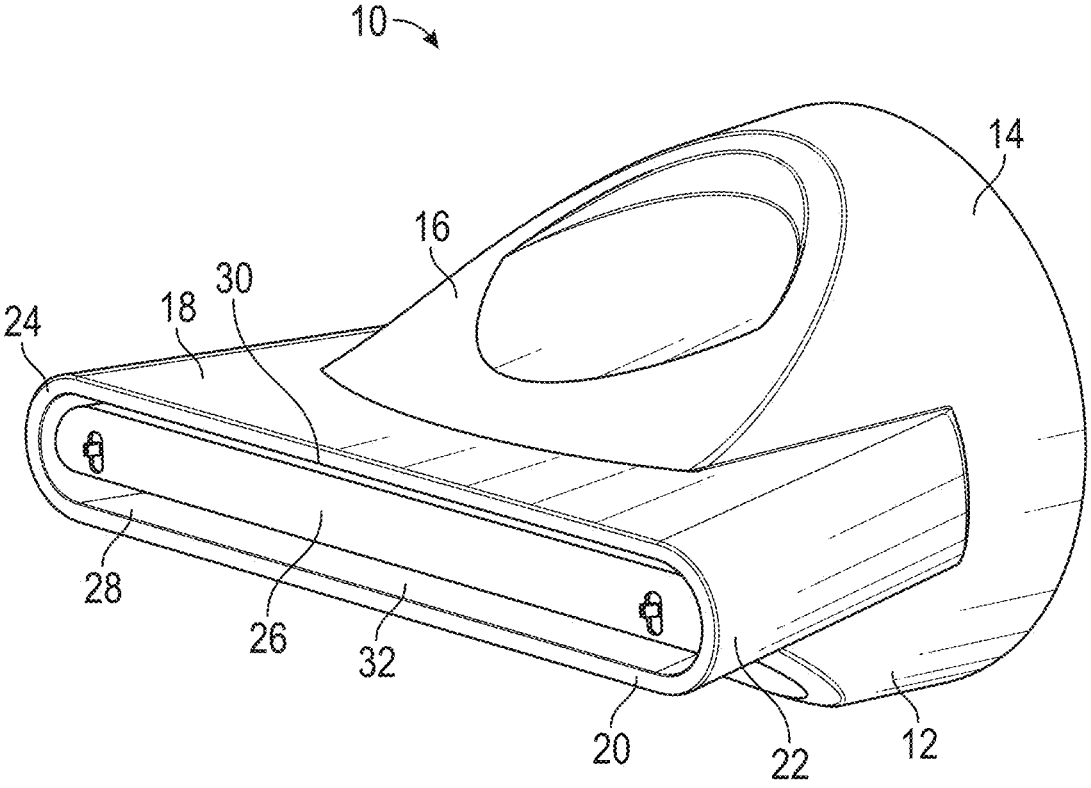
FIG. 1 is a perspective view of a concentrator attachment for a hair dryer, according to an embodiment of the present invention.
Figure 2:
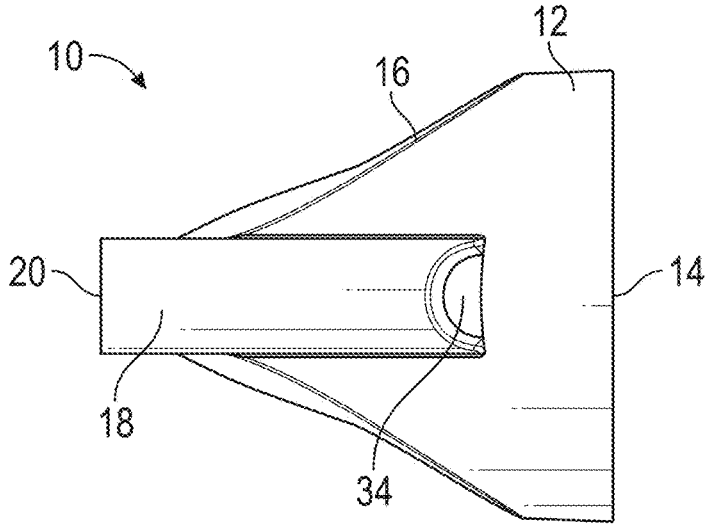
FIG. 2 is a side elevational view of the concentrator attachment of FIG. 1.
Figure 3:
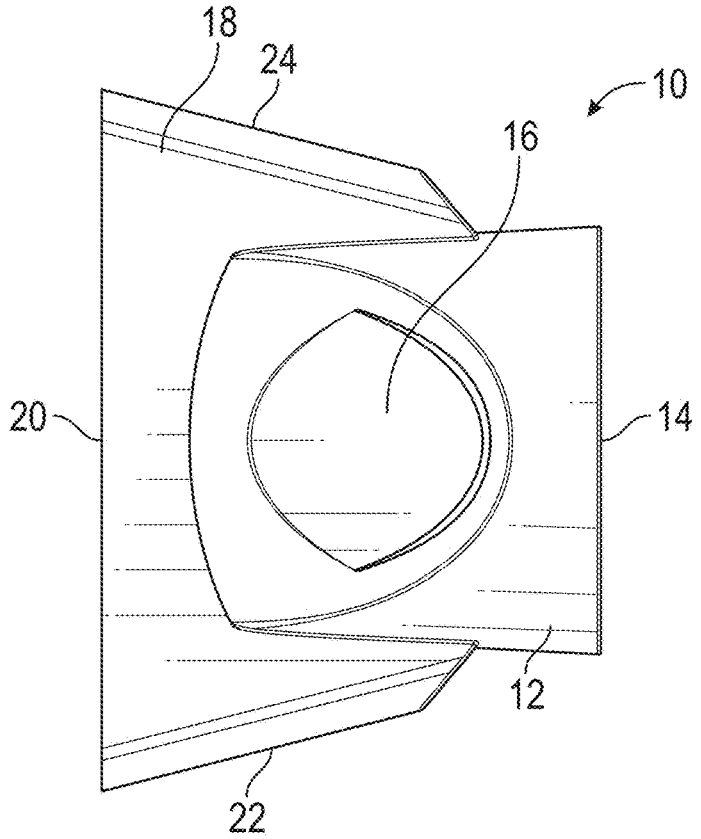
FIG. 3 is a top plan view of the concentrator attachment of FIG. 1.

With reference to FIGS. 1-3, a hair dryer accessory 10 (also referred to herein as a styling attachment) according to an embodiment of the present invention is shown. As shown therein, the styling attachment 10 defines a housing 12 having an attachment end 14 configured for fastening the attachment to a styling device using friction or other fastening means known in the art. In an embodiment, the attachment end 14 is configured as a cylindrical or slightly conical hub configured to closely receive the nozzle end of a hair dryer therein. Extending from the hub is a tapered portion 16 having a truncated cone shape, from which extends a nozzle 18 having an outlet end 20 through which air passes from the hair dryer to a user's hair.

As illustrated therein, the nozzle 18 and the outlet end 20 thereof is generally rectangular in shape, and has a length (in the horizontal direction shown in FIG. 1) that is substantially greater than a height (in the vertical direction shown in FIG. 1). In an embodiment, the sides 22, 24 of the nozzle are arcuate in shape. Thus, the nozzle 18 and outlet end 20 are formed as a narrow slot that functions to concentrate air output by the hair dryer. The styling attachment 10 may also include a pair of openings 34 at a point where the nozzle intersects the tapered portion 16 and/or hub, as shown in FIG. 2. As best shown in FIG. 1, in an embodiment, the nozzle 18 includes a styling bar 26 (styling component)

mounted within the opening 28 defined by the nozzle 18 adjacent to the outlet end 20. In an embodiment, the bar 26 is mounted within the opening 28 using screws or rivets, although other fastening means known in the art may also be utilized without departing from the broader aspects of the invention. In an embodiment, the bar 26 is mounted equidistant from the top wall of the nozzle and the bottom wall of the nozzle, although it is envisioned that other mounting arrangements (such as closer to the top wall or bottom wall) are possible.

As further shown in FIG. 1, the bar 26 thus obstructs the airflow through the nozzle 18, forcing the air to move around the bar 26 and exit the nozzle through narrow passages 30, 32 between the top of the bar 26 and the top wall of the nozzle 18, and the bottom of the bar 26 and the bottom wall of the nozzle 18, respectively. Accordingly, in use, air can flow around and past the bar 26, as the bar does not entirely block off the flow path but, instead, permits air flow around the upper and lower edges of the bar. As illustrated in FIG. 1, the bar 26 is rectangular in shape (e.g., cross-sectional shape), although other shapes such as triangular, square, pentagonal, hexagonal, octagonal, circular, etc. are envisioned. Moreover, while the bar 26 is illustrated as being solid, in other embodiments, the bar 26 may contain one or more slots, through holes, recesses, protrusions or the like. For example, in an embodiment, the bar 26 may entirely obstruct the opening 28, but may have a plurality of through holes that allow air to pass through the bar 26 (rather than around the bar 26). In another embodiment, the bar 26 may be sized so as to allow air to pass through narrow openings 30, 32 as described above, and may also include a plurality of through holes allowing the air to pass through the bar 26, which may aid in heating the bar 26 as well as minimize airflow disruption. In addition, in yet other embodiments, a plurality horizontally or vertically spaced bars within opening 28 may be utilized.

In an embodiment, the bar 26 is mounted so as to be coplanar with the outlet end 20 of the opening 28. In another embodiment, the bar 26 is mounted so as to be spaced inwardly (inset) with respect to a plane defined by the outlet end 20. In yet another embodiment, the bar 26 is mounted so as to protrude beyond the plane defined by the outlet end 20.

In an embodiment the bar 26 is made of glass or a glass-like material. In other embodiments, the bar 26 may be made of ceramic or other materials capable of absorbing and retaining heat from the heated air contacting the bar 26 from the nozzle of the hair dryer, for the purposes described hereinafter.

Figure 4:
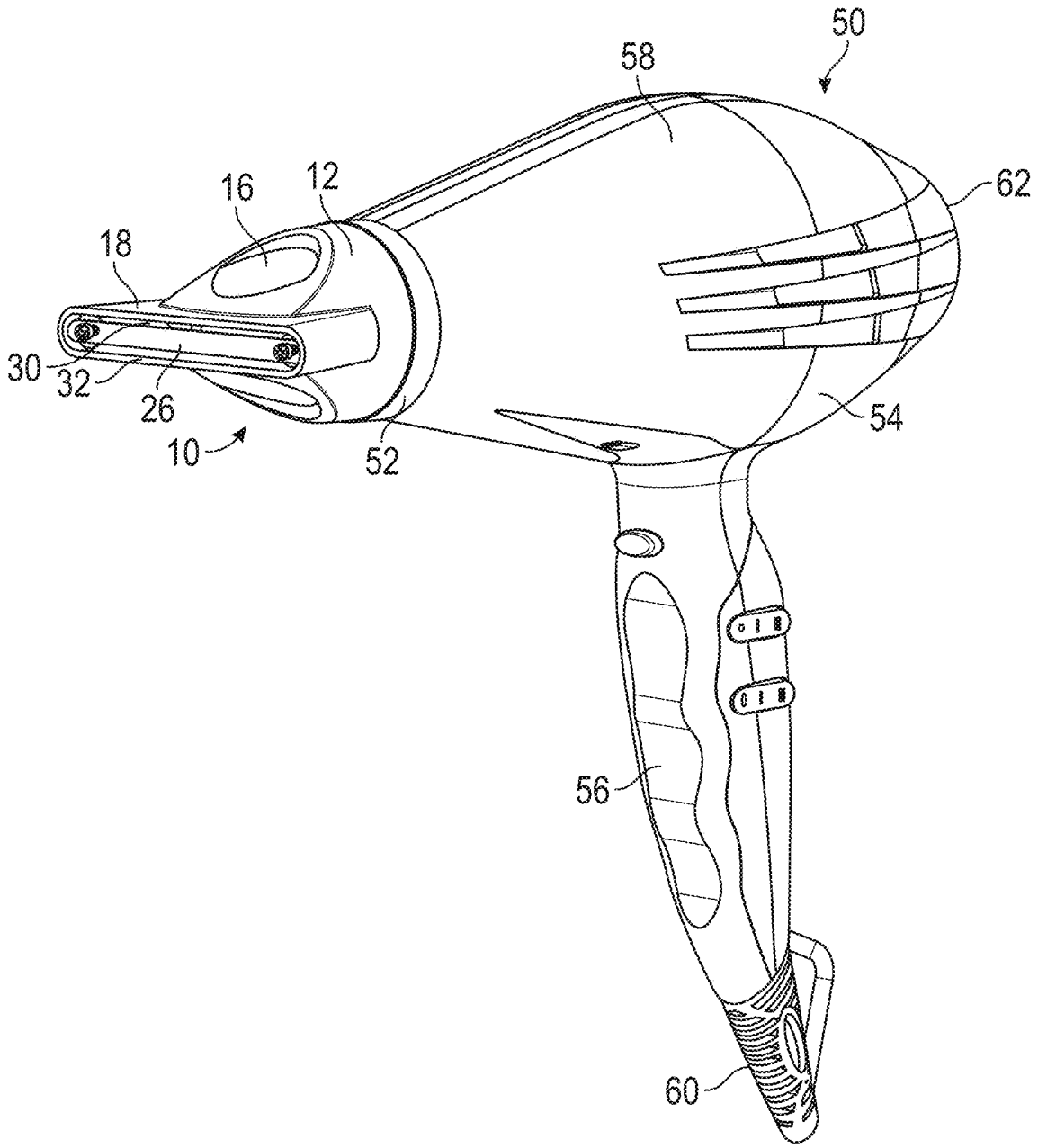
FIG. 4 is a perspective view of a hair dryer with the concentrator attachment of FIG. 1 attached to the nozzle thereof.

With reference to FIG. 4, in use, the styling attachment 10 is mounted to the nozzle 52 of a hair dryer 50 in a manner heretofore known in the art. The hair dryer 50 may be of the conventional type, having a housing 54 having a handle portion 56, a head portion 58 connected to an upper end of the handle portion 56, and a nozzle or barrel 52 connected to or otherwise forming a part of, and extending from, the head portion 56. The head portion 58 and nozzle 52 may collectively be referred to as the nozzle portion. A power supply or power cord 60 is connected to the distal, lower end of the handle 56 to provide electricity to the hair dryer 50. The power cord 60 is configured to engage a suitable electrical outlet (e.g., a wall outlet, etc.). However, in other embodiments, any suitable source of electricity may be incorporated into the hair dryer 50, including, but not limited to a battery or rechargeable battery.

As further shown therein, and as known in the art, housing 54 includes an air inlet 62 associated with the rear end of the nozzle 52, and an air outlet associated with the forward end of the nozzle 52 (not shown). Other hair dryer configurations or types are also possible. The hair dryer 50 further includes a motor (not shown) and a fan (not shown) drivingly connected to the motor within the housing 54. In operation, air is drawn into the hair dryer 50 through the air inlet 62 via operation of the fan, where it is concentrated, optionally heated, and emitted through the nozzle outlet in a manner known in the art. For example, the hair dryer 50 may also include a heating element (not shown) for heating the air as it passes through the nozzle 52. In an embodiment, the heating element may be a coiled nichrome wire wrapped around insulating mica boards positioned within the nozzle, although other heating elements/mechanisms known in the art may also be utilized without departing from the broader aspects of the invention.

In use, when the hair dryer 50 is turned on, a flow of heated air exits the nozzle 52 and enters the styling attachment 10 where is flows through tapered portion 16 and into nozzle 18. The heated air contacts the bar 26, heating the bar 26. The bar 26 also redirects the airflow above and below the bar 26, where it exits the nozzle 18 through narrow passages 30, 32. During use, the user can move or position the hair dryer 50 and/or styling attachment 10 so that the glass bar 26 makes contact with the hair to transfer heat from the bar 26 in order to aid in straighten or style the hair (e.g. curling with a brush, etc.), add shine/reduce frizz due to contact and relative movement of the glass bar 26 along the hair, and remove static (depending on the properties of the glass, such as in the case of some ceramics).

Importantly, even after the hair dryer 50 is turned off and ceases to output a flow of air, the bar 26 (and the heat retained in the bar 26) can still be used to style the hair, since the bar 26 will remain heated for a period of time.

In an embodiment, the configuration of the bar 26 is chosen so that a total surface area of the bar 26 is greater than a cross-sectional area of the opening. In another embodiment, the configuration of the bar 26 is selected so that the surface area of the forward-most surface of the bar 26 is greater than the combined cross-sectional area of the passages 30, 32 (that is, that the bar 26 occupies a greater cross-sectional area of the opening 28 than do the passages 30, 32). This ensures that it is not, primarily, the heated air contacting the hair but, instead, the heated glass bar (without air flow and its potentially over drying effect) directly contacting the hair. The configuration of the styling attachment 10 is therefore such that it allows the user to hold the bar 26 in contact with the hair, close to the scalp, for a longer period of time due to reduced air flow locally at the bar, or in OFF mode where the retained heat of the bar is put to use.

While FIGS. 1-4 illustrate a single primary opening within which the bar 26 is positioned, it is not intended that the present invention be so limited in this regard. In particular, in some embodiments, the styling attachment 10 may include one or more supplemental air flow exit openings that are separate from the main opening, and which allow air to pass through the styling attachment 10 without contacting the bar 26. In an embodiment, the bar 26 may entirely obstruct the main opening at the nozzle end so that heated air emitted by the hair dryer directly impinges upon the bar 26 to heat the bar. In this case, supplemental air flow exit openings may be provided within the tapered portion 16, nozzle 18 or other area of the device 10 so that the heated air produced by the hair dryer can exit. Moreover, while the bar 26 has been disclosed above as being formed from a glass, glass-like or ceramic material, it is also contemplated that other materials capable of withstanding temperatures encountered in hair dryers and that have heat retention and heat conductive properties that produce the desired effect, such as metal, metal alloys, stone and the like may also be utilized.

In addition to the above, in some embodiments, the bar 26 may be injected with, embedded with, impregnated with, coated, or otherwise formed with additional materials in the form of fragments, coatings, or injection molded substances configured to produce one or more desired effects on a user's hair such as, for example static charge reduction, ionization, fragrance, lubrication, abrasive action, smoothing action, etc.

Referring now to FIGS. 5-8, a styling attachment 100 according to another embodiment of the present invention is illustrated. As shown therein, the styling attachment 100 is generally similar to styling attachment 10, but rather than being configured as a concentrator to concentrate the flow of air from a hair dryer, is configured as a pick or comb. As shown therein, the attachment 100 defines a housing 112 having an attachment end 114 configured for fastening the attachment to a styling device using friction or other fastening means known in the art. In an embodiment, the attachment end 114 is configured as a cylindrical or slightly conical hub configured to closely receive the nozzle end of a hair dryer therein. Extending from the hub is a tapered portion 116 having a truncated cone shape, from which extends a nozzle 118 having an outlet end 120 through which air passes from the hair dryer to a user's hair.

Figure 5:
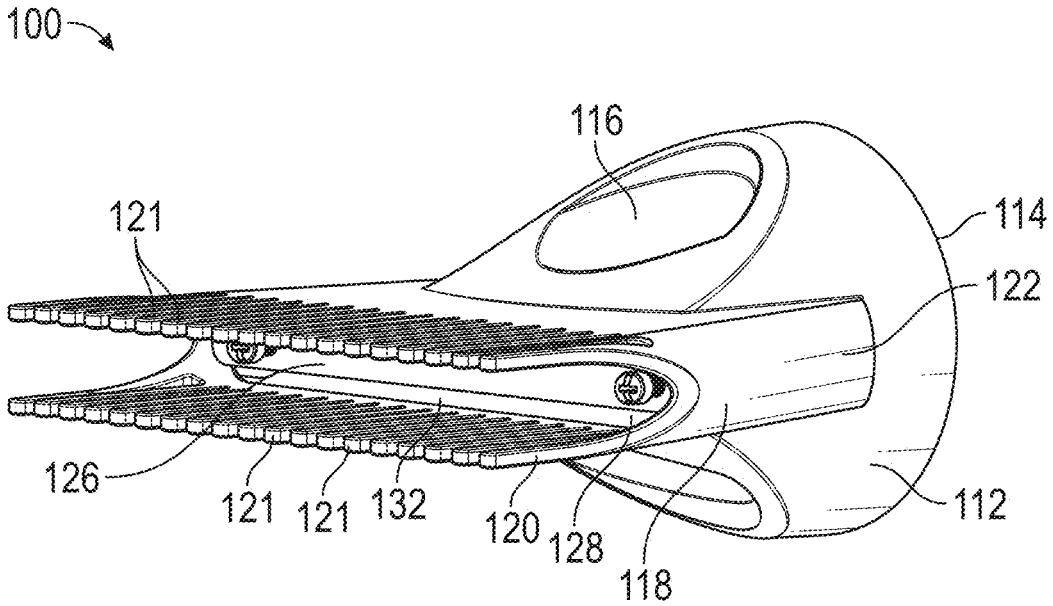
FIG. 5 is a perspective view of a pick attachment for a hair dryer, according to an embodiment of the present invention.
Figure 6:
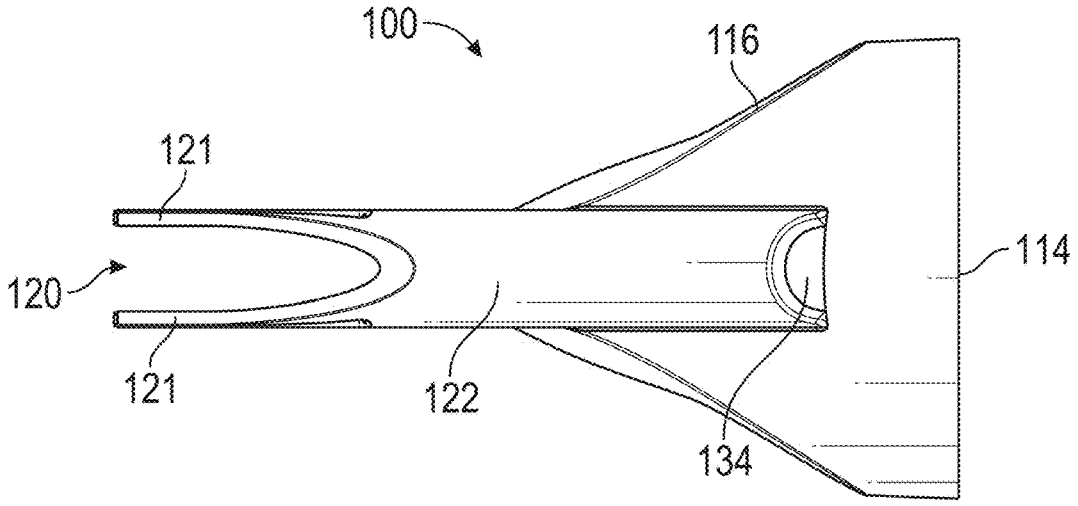
FIG. 6 is a side elevational view of the pick attachment of FIG. 5.
Figure 7:
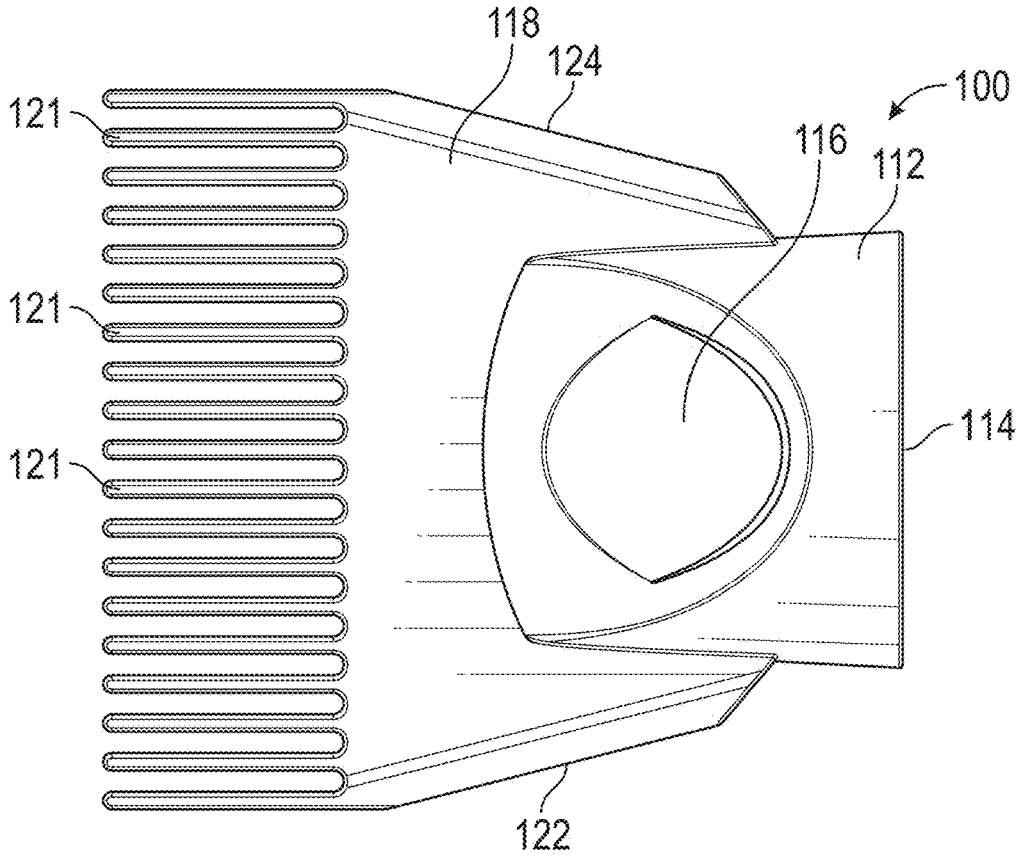
FIG. 7 is a top plan view of the pick attachment of FIG. 5.

As illustrated therein, the nozzle 118 is generally rectangular in shape, and has a length (in the horizontal direction shown in FIG. 5) that is substantially greater than a height (in the vertical direction shown in FIG. 5). In an embodiment, the sides 122, 124 of the nozzle are arcuate in shape. Thus, the nozzle 118 and outlet end 120 are formed as a narrow slot that functions to concentrate air output by the hair dryer. The styling attachment 100 may also include a pair of openings 134 at a point where the nozzle 118 intersects the tapered portion 116 and/or hub, as shown in FIG. 6. Additionally, the nozzle 118, at its distal end includes an upper and lower row of teeth or tines 121 (arranged above and below the opening 128 defined by the nozzle 118, respectively).

As best shown in FIG. 5, similar to the attachment 10, the nozzle 118 includes a bar 126 mounted within the opening 128 defined by the nozzle 118 and positioned adjacent to the root or base of the tines 121. The bar 126 may be secured using any means known in the art, as described above, such as using screws or rivets. Similar to the embodiment above, the bar 126 may be mounted equidistant from the top wall of the nozzle and the bottom wall of the nozzle, although it is envisioned that other mounting arrangements (such as closer to the top wall or bottom wall) are possible.

As further shown in FIG. 5, the bar 126 thus obstructs the airflow through the nozzle 118, forcing the air to move around the bar 126 and exit the nozzle through narrow passages 130 between the top of the bar 126 and the top wall of the nozzle 118, and the bottom of the bar 126 and the bottom wall of the nozzle 118, respectively. Accordingly, in use, air can flow around and past the bar 126, as the bar does not entirely block off the flow path but, instead, permits air flow around the upper and lower edges of the bar. As illustrated in FIG. 5, the bar 126 is rectangular in shape (e.g., cross-sectional shape), although other shapes such as triangular, square, pentagonal, hexagonal, octagonal, circular, etc. are envisioned, as described above. The bar 126 is preferably formed from a glass or glass-like material capable of absorbing and retaining heat, although any of the materials disclosed above may also be utilized.

Figure 8:
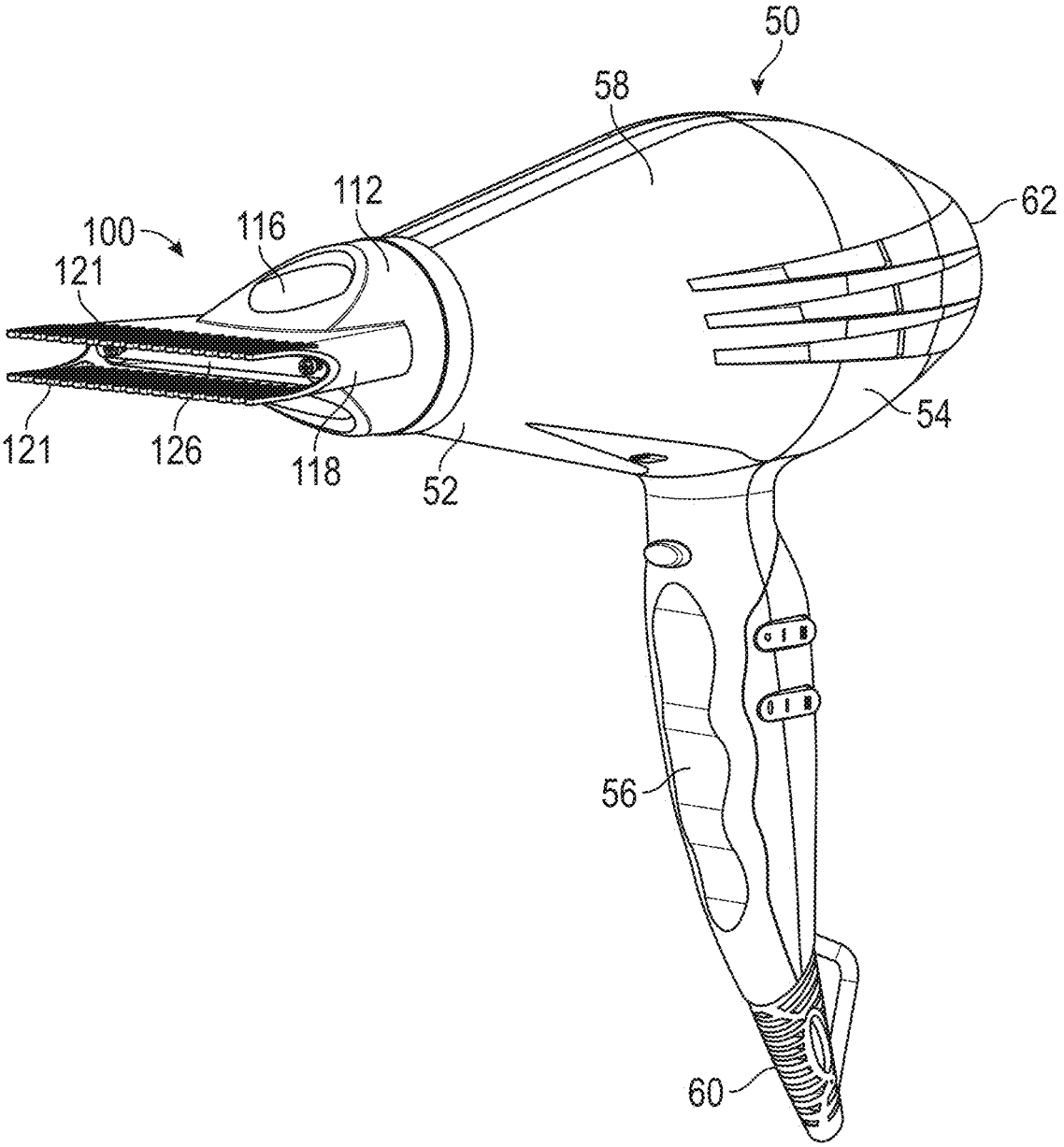
FIG. 8 is a perspective view of a hair dryer with the pick attachment of FIG. 5 attached to the nozzle thereof.

FIG. 8 illustrates the styling attachment 100 secured to hair dryer 50. In use, when the hair dryer 50 is turned on, a flow of heated air exits the nozzle 52 and enters the styling attachment 100 where is flows through tapered portion 116 and into nozzle 118. The heated air contacts the bar 126, heating the bar 116. The bar '26 also redirects the airflow above and below the bar 126, where it exits the nozzle 18 through narrow passages 30. During use, the user can move or position the hair dryer 50 and/or styling attachment 100 so that the glass bar 126 makes contact with the hair to transfer heat from the bar 126 in order to aid in straighten or style the hair (e.g. curling with a brush, etc.), add shine/reduce frizz due to contact and relative movement of the glass bar 126 along the hair, and remove static (depending on the properties of the glass, such as in the case of some ceramics).

Similar to the embodiment of FIGS. 1-4, the configuration of the bar 126 is chosen so that a total surface area of the bar 126 is greater than a cross-sectional area of the opening 128. In another embodiment, the configuration of the bar 126 is selected so that the surface area of the forward-most surface of the bar 126 is greater than the combined cross-sectional area of the passages 30 (that is, that the bar 126 occupies a greater cross-sectional area of the opening 128 than do the passages 30). This ensures that it is not, primarily, the heated air contacting the hair but, instead, the heated glass bar (without air flow and its potentially over drying effect) directly contacting the hair. The configuration of the styling attachment 100 is therefore such that it allows the user to hold the bar 126 in contact with the hair, close to the scalp, for a longer period of time due to reduced air flow locally at the bar, or in OFF mode where the retained heat of the bar is put to use, as described above.

In an embodiment, it is contemplated that the teeth or tines 121, themselves, may be formed from or otherwise coated with a glass material similar to the material of the bar 126, so that the tines 121 may also aid in heat retention, removing static from a user's hair, and adding shine to a user's hair.

It is further envisioned that any of the alternative configurations of the bar 26 of attachment 10 disclosed above are equally applicable to bar 126 of attachment 100 (e.g., material, additives, holes, recesses, protrusions, location, etc.). Moreover, it is envisioned that the heat retaining bar of the attachments 10, 100 disclosed herein can be utilized in a variety of attachments for personal styling devices such as hair dryers, and is not limited to use in the attachments disclosed herein. In any such devices, it is contemplated that the bars can be selectively removable so that the attachment can be used with or without the heat retention bar.

As a final matter, in an embodiment, the heat retaining bars disclosed herein, rather than be integrated with an attachment for a hair dryer, can be integrated with (e.g., removably attached to) the nozzle of a hair dryer, itself. Similarly, in an embodiment, the entire accessory 10, rather than being configured as an attachment that can be removable connected to the nozzle end of a hair dryer, may be integral with, or otherwise form a permanent part of the nozzle end of a hair dryer.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof.

Therefore, it is intended that the invention not be limited to the particular embodiments disclosed in the above detailed description, but that the invention will include all embodiments falling within the scope of this disclosure.

What is claimed is:

1. A styling attachment for a hair dryer, comprising:

a hub having a tapered distal portion and an annular proximal portion configured for releasable attachment to a nozzle of a hair dryer;

a nozzle extending distally from the tapered distal portion of the hub, the nozzle having a flat upper wall, a flat lower wall disposed parallel to the flat upper wall, convexly arcuate side walls joining opposing ends of the flat upper and lower walls, a flat distal end surface and an elongated opening between inner surfaces of the upper wall, the lower wall, and the convexly arcuate side walls; and a bar mounted within the elongated opening and spaced proximally from the flat distal end surface, the bar having a flat front surface with a perimeter defined by parallel top and bottom linear edges and convexly arcuate side edges joining opposing ends of the top and bottom linear edges, wherein the bar is configured to at least partially obstructing a flow of air from a hair dryer through the elongated opening;

wherein a single continuous air passage exists within the elongated opening between the perimeter of the bar and the inner surfaces of the upper wall, lower wall and convexly arcuate side walls of the nozzle, wherein the bar is solid, the flat front surface is continuous and has a surface area greater than a cross-sectional area of the single continuous air passage surrounding the bar, wherein the bar has a height between the top and bottom linear edges that is greater than a height of the continuous air passages above and below the bar and the bar has a length defined as the distance between the convexly arcuate side edges, where the length of the bar is greater than the height of the bar;

wherein the bar is configured to retain heat from the flow of air contacting the bar, and to transfer the heat to the hair of a user when the bar is contacted with the hair; and wherein the bar is formed from glass.

2. The styling attachment of claim 1, wherein:

the bar is configured so as to obstruct substantially an entire area of the opening.

3. The styling attachment of claim 2, further comprising:

at least one auxiliary opening for the egress of the air from the styling attachment, the at least one auxiliary opening being spaced from the opening in the nozzle of the styling attachment.

4. The styling attachment of claim 1, wherein:

the bar includes a material configured to impart at least one of static charge reduction, ionization, fragrance, lubrication, abrasive action, and/or smoothing action to a user's hair when the bar is contacted with the user's hair.

5. The styling attachment of claim 4, wherein:

the bar is at least one of embedded with, coated with or impregnated with the material.

6. The styling attachment of claim 1, further comprising:

a plurality of elongate teeth surrounding the opening.

* * * * *